US009711271B2

(12) United States Patent
Blanke

(10) Patent No.: US 9,711,271 B2
(45) Date of Patent: Jul. 18, 2017

(54) PLANAR TRANSFORMER

(71) Applicant: Phoenix Contact GmbH & Co. KG, Blomberg (DE)

(72) Inventor: Joerg Blanke, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/443,194

(22) PCT Filed: Nov. 12, 2013

(86) PCT No.: PCT/EP2013/073594
§ 371 (c)(1),
(2) Date: May 15, 2015

(87) PCT Pub. No.: WO2014/076067
PCT Pub. Date: May 22, 2014

(65) Prior Publication Data

US 2015/0332838 A1 Nov. 19, 2015

(30) Foreign Application Priority Data

Nov. 16, 2012 (DE) ..... 10 2012 111 069

(51) Int. Cl.
*H01F 5/00* (2006.01)
*H01F 27/28* (2006.01)
*H01F 27/24* (2006.01)

(52) U.S. Cl.
CPC ..... *H01F 27/2804* (2013.01); *H01F 27/24* (2013.01); *H01F 27/2895* (2013.01);
(Continued)

(58) Field of Classification Search
CPC ..... H01F 5/00; H01F 27/28
(Continued)

(56) References Cited

U.S. PATENT DOCUMENTS 1,743,318 A 1/1930 Carrington
2,788,486 A 4/1957 Guggi
(Continued)

FOREIGN PATENT DOCUMENTS

CN 101625380 A 1/2010
CN 101996738 A 3/2011
(Continued)

OTHER PUBLICATIONS

"German Office Action", issued in parent application No. 10 2012 111 069.7 on Apr. 19, 2013.
(Continued)

*Primary Examiner* — Tsz Chan
(74) *Attorney, Agent, or Firm* — Kaplan Breyer Schwarz, LLP

(57) ABSTRACT

A planar transformer is provided, which comprises a plate-shaped conductor substrate with integrated primary winding, secondary winding and coupling winding. The conductor substrate has pairs of recesses, and a respective two-part ferromagnetic core having yoke legs is inserted through each pair of recesses. One leg of each core is surrounded by the primary winding or the secondary winding, while the coupling winding is looped around the remaining legs of the cores. At least a minimum total isolation separation distance made up of partial isolation separation distances between the coupling winding and adjacent yoke legs or adjacent windings is maintained for electrical isolation between the primary winding and the secondary winding.

2 Claims, 8 Drawing Sheets

(52) U.S. Cl.
CPC ..... *H01F 2027/2809* (2013.01); *H01F 2027/2819* (2013.01)

(58) Field of Classification Search
USPC ..... 336/184, 200, 212, 232
See application file for complete search history.

(56) References Cited

U.S. PATENT DOCUMENTS

| | | | | |
|---|---|---|---|---|
| 4,201,965 | A * | 5/1980 | Onyshkevych | H01F 27/2804 336/180 |
| 5,432,439 | A * | 7/1995 | Svoen | G01R 15/185 323/357 |
| 7,187,263 | B2 | 3/2007 | Vinciarelli | |
| 8,022,802 | B2 | 9/2011 | Schaerrer et al. | |
| 2008/0278275 | A1 | 11/2008 | Fouquet et al. | |
| 2010/0007358 | A1 * | 1/2010 | Schaerrer | G01R 15/14 324/649 |
| 2010/0079233 | A1 * | 4/2010 | Koprivnak | H01F 27/2804 336/200 |
| 2011/0095620 | A1 | 4/2011 | Fouquet et al. | |
| 2011/0140824 | A1 | 6/2011 | Herhold | |
| 2012/0098633 | A1 | 4/2012 | Schlenk et al. | |

FOREIGN PATENT DOCUMENTS

| | | | |
|---|---|---|---|
| DE | 2529296 | A1 | 1/1977 |
| DE | 4317545 | A | 4/1994 |
| DE | 19515494 | A1 | 10/1996 |
| DE | 19637733 | C1 | 1/1998 |
| DE | 102005041131 | A1 | 5/2007 |
| DE | 202009002383 | U1 | 5/2009 |
| DE | 102009037430 | A1 | 3/2011 |
| DE | 102009037340 | A1 | 8/2011 |
| EP | 0715322 | A1 | 6/1996 |
| EP | 0864165 | B1 | 8/2000 |
| JP | 2007103477 | A | 4/2007 |
| JP | 2008141182 | A * | 6/2008 |
| JP | 2009218392 | A * | 9/2009 |
| JP | 2011154581 | A | 8/2011 |
| JP | 2011181889 | A | 9/2011 |
| WO | 2012001398 | A2 | 1/2012 |

OTHER PUBLICATIONS

"International Application No. PCT/EP2013/073594 International Search Report", Feb. 12, 2014, Publisher: International Searching Authority / EPO, Published in: NL.

International Preliminary Report on Patentability, dated May 28, 2015, issued in counterpart International Patent Application PCT/EP2013/073594.

"Office Action" issued in counterpart Chinese Patent Application No. 201380059544.9, dated May 19, 2016, Published in: CN.

* cited by examiner section I-J

PLANAR TRANSFORMER

FIELD OF THE INVENTION

The invention relates to a planar transformer comprising a primary winding, a secondary winding, a coupling winding, and a conductor substrate which carries one or more magnetic core rings.

BACKGROUND OF THE INVENTION

U.S. Pat. No. 8,022,802 B2 relates to a sensor for measuring electrical parameters in a high voltage environment and comprises isolation transformers in several embodiments, including one embodiment with a single main circuit board for a plurality of adjacently disposed windings which are coupled magnetically by magnetic core rings, and a further embodiment with a main circuit board, a secondary circuit board and two magnetic core rings which extend through openings of the main and secondary circuit boards. The primary winding and the secondary winding are arranged in and on the main circuit board, while the coupling winding for coupling the two magnetic core rings is arranged on the secondary circuit board. There is some intermediate space between the two circuit boards, and furthermore the coupling winding on the secondary circuit board is spaced from the respective edge of the openings in the magnetic core rings. In this way, relatively large ring core openings are required in the magnetic core rings.

In another transformer (DE 10 2005 041 131 A1), windings are wound around the ferromagnetic cores to form coils, and the windings of the coils are arranged on different ferromagnetic cores in order to maintain required isolation distances. The ferromagnetic cores are magnetically coupled to one another by an additional winding embedded in a circuit board. Because the winding has to be wound around the ferromagnetic cores, manufacturing of a transformer of this configuration is only possible at high costs.

From US 2011/0140824 A1 a transformer is known in which windings that have to be separated with respect to their potential are asymmetrically arranged on different circuit boards which are stacked and connected to form the transformer using a two-part ferromagnetic core.

US 2011/0095620 A1 discloses a planar transformer for miniaturized applications which has coil windings disposed on opposite sides of an insulating substrate. The device operates based on induction, without ferromagnetic cores.

EP 0 715 322 A1 discloses a planar type transformer comprising conductor tracks that are disposed in layers of a circuit board thus forming transformer windings. A ferromagnetic core surrounds the transformer windings, with outer annular legs and with a cylindrical inner leg.

DE 20 2009 002 383 U1 discloses a planar transformer comprising a multi-layered circuit board which ensures high dielectric strength among the layers of the circuit board between the primary and the secondary windings. The transformer can be driven floating with opposing signals. A signal to be transmitted in the positive direction of magnetic flux of a common primary winding or an individual primary winding directly generates a positive control signal in a first secondary winding in the same coupling direction. A signal in the negative direction of magnetic flux of a second or of the same winding directly generates a likewise positive control signal in a second secondary winding in a coupling direction opposite to that of the first secondary winding, or a negative control signal in the first secondary winding, and if no further signal is to be transmitted, the transformer is automatically or digitally controlled by circuit elements so as to be demagnetized by driving one or two windings in short circuit directly at the end of a previously transmitted signal.

DE 10 2009 037 340 A1 discloses a transformer in which annular cores with windings are coupled with each other by a short-circuit winding. The short-circuit winding is connected to respective contacts of a circuit board, for example by soldering.

The invention is based on the object to provide a planar transformer that is easily manufactured and that provides for electrical isolation or potential separation for two or more potential groups in a very small space.

SUMMARY OF THE INVENTION

The novel planar transformer comprises at least two ferromagnetic cores having yoke legs, and a single plate-shaped conductor substrate for defining a primary winding and at least one secondary winding which are coupled with each other by at least one coupling winding. The conductor substrate forms a plate-shaped support for the ferromagnetic cores which are split to form assemblable yoke core halves and which have at least two yoke leg that can be inserted into and through recesses in the conductor substrate so as to form a respective magnetic core ring when the yoke core halves are closed.

In order to achieve electrical isolation between primary and secondary windings in a very small space, it has to be accepted that the magnetic core rings only maintain small separation distances to the plate-shaped conductor substrate which supports portions of the primary winding in the region of a first ring core opening and portions of the secondary winding in the region of a second ring core opening close to the surface of the conductor substrate. Thus, the respective magnetic core ring is allocated, in terms of potential, to the adjacent primary winding or secondary winding, respectively, although of course an insulating layer that is referred to as functional isolation separates the respective winding from the ferromagnetic material of the at least two magnetic core rings which are arranged spaced from each other and are electromagnetically coupled with each other through the coupling winding, but lie at different potentials (that of the primary winding or the secondary winding). Therefore, the coupling winding must maintain a sufficient isolation separation distance to the adjacent inner surfaces of the ring core openings and to adjacent turns of the primary winding and secondary winding, so that the potentials can be separated from one another by a total isolation separation distance. This total isolation separation distance can be split to the respective separation distances between the coupling winding and the ring core opening and/or the adjacent turns of the primary winding and secondary winding, however with a respective minimum separation distance that must be maintained in each case.

In a first configuration, one leg of the magnetic core ring is surrounded by the primary winding, while the other leg is looped by a first portion of the coupling winding which has a second portion that is looped around the leg of an adjacent ring core which has a further leg that is surrounded by the secondary winding. A plurality of secondary magnetic core rings surrounded by secondary windings may be coupled with a single primary magnetic core ring.

In a second configuration, a respective first leg of the two magnetic core rings is looped by two windings in different layer planes of the conductor substrate, with the coupling winding coupling the two magnetic core rings, while the primary winding is associated with one magnetic core ring and the secondary winding is associated with the other magnetic core ring. If a respective second leg of the two magnetic core rings is free of the windings mentioned above in one of the different layer planes of the conductor substrate, an auxiliary winding may be arranged there, for example for control purposes. However, it is also possible to continue the primary winding or the secondary winding with a portion around the free leg.

By providing the magnetic core rings in form of two-part yoke cores and the windings including the coupling winding as integral parts of the plate-shaped conductor substrate, manufacturing of the planar transformer is simplified, since it is only necessary to insert the legs of the yoke cores into and through the recesses in the plate-shaped conductor substrate and to complete them to form a respective magnetic core ring. At the same time, this configuration allows for good space utilization of the ring core opening accompanied by electrical isolation between adjacent magnetic core rings.

BRIEF DESCRIPTION OF THE FIGURES

Exemplary embodiments of the invention will now be described with reference to the drawings, wherein.

DETAILED DESCRIPTION

Figure 1:
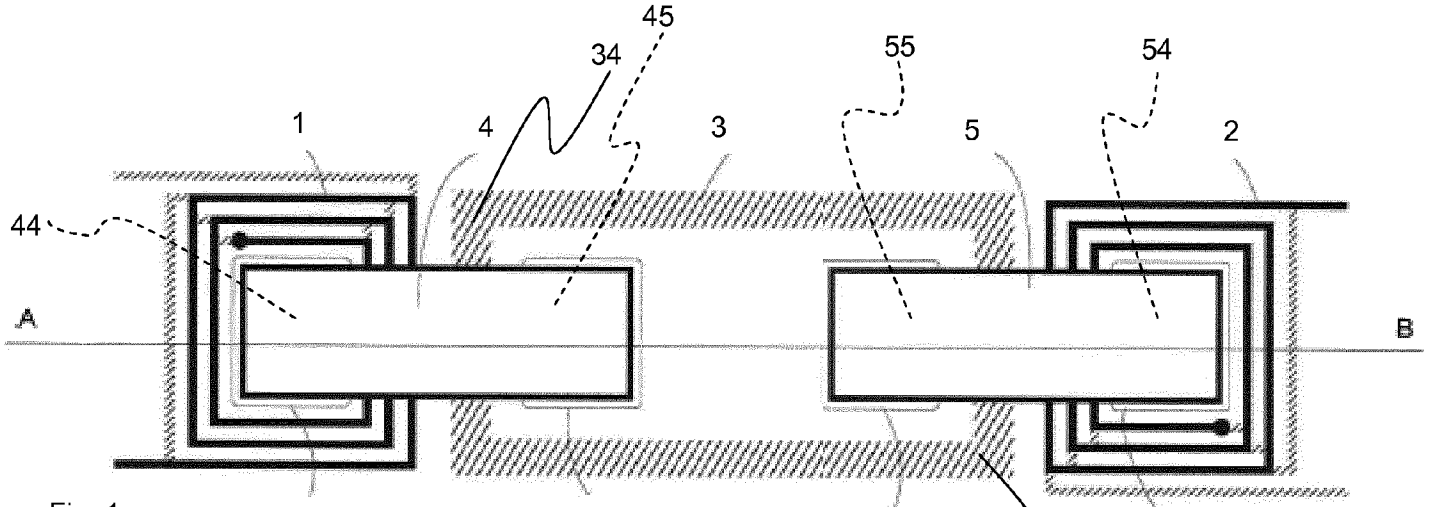
FIG. 1 is a schematic plan view of a first configuration of a planar type transformer.
Figure 2:
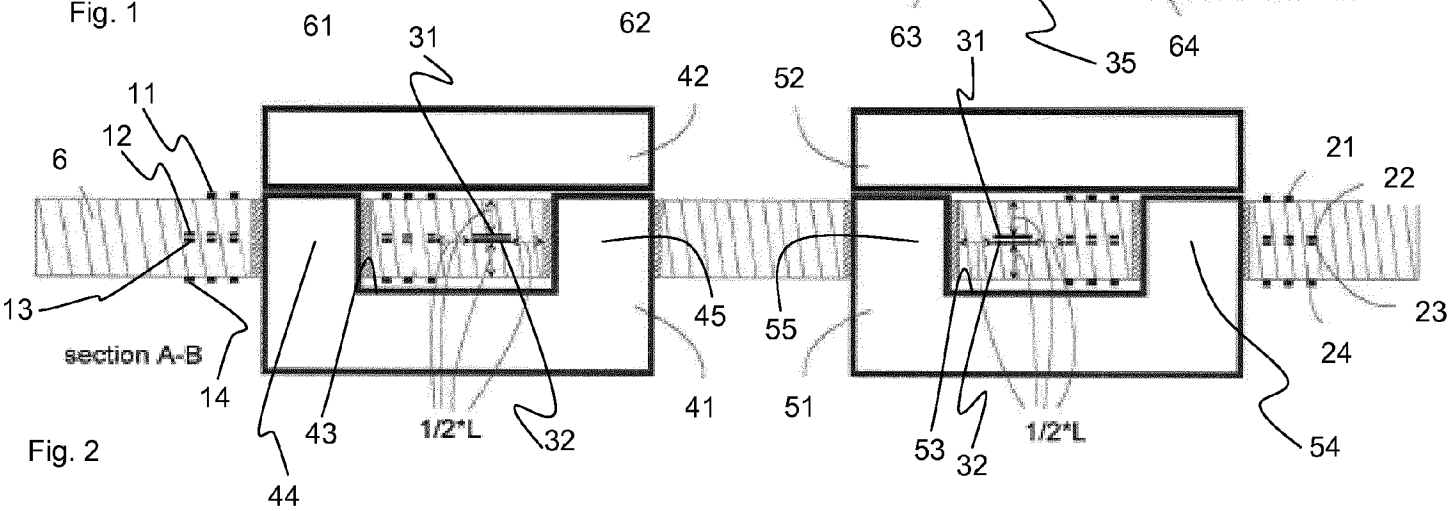
FIG. 2 is a sectional view of the transformer of FIG. 1 taken along line A-B.
Figure 9:
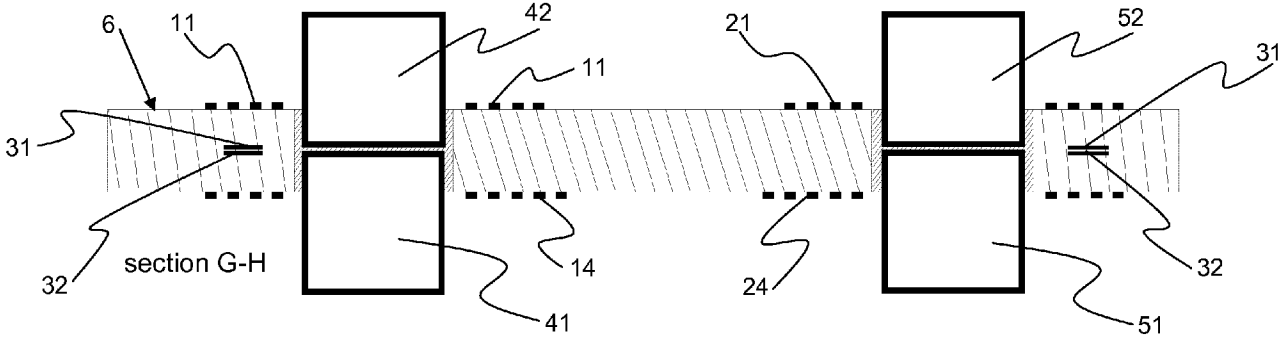
FIG. 9 is a sectional view of the transformer of FIG. 8 taken along line G-H.

FIGS. 1 and 2 illustrate a first embodiment of a planar type transformer according to the invention. Principal parts of the transformer include a primary winding 1, a secondary winding 2, a coupling winding 3, a first two-part magnetic core ring 4, a second two-part magnetic core ring 5, and a single plate-shaped conductor substrate 6. Magnetic core rings 4, 5 each comprise two yoke core halves 41, 51, and 42, 52, which can be closed to form a ring 4 with a first ring core opening 43 and a ring 5 with a second ring core opening 53. Magnetic core rings 4, 5 each have passing legs 44, 45 and 54, 55 and connecting legs between the passing legs. Leg 44 and 54, respectively, may belong to the one or to the other core half 41, 42 and 51, 52, respectively, or may even be divided, as illustrated in FIG. 9. Plate-shaped conductor substrate 6 has two pairs of recesses 61, 62, and 63, 64 which define openings for the passing legs 44, 45 and 54, 55 of magnetic core rings 4, 5. Recess pairs 61, 62 and 63, 64 are separated from one another by an isolation distance and accommodate the passing legs 44, 45, and 54, 55 of magnetic core rings 4, 5. Primary winding 1 surrounds recess 61 in a plurality of layer planes of the conductor substrate 6, which extend on the surface of the conductor substrate or close to the surface and in the interior of the conductor substrate, and four of these layer planes 11, 12, 13, 14 are indicated in the figure. Conductor substrate 6 nearly fills the ring core openings 43 and 53.

As indicated in FIG. 1, primary winding 1 runs along a spiral path in each layer plane. The four spiral shapes are interconnected to give the primary winding 1. Similarly, spiral shapes of the secondary winding are provided in four layer planes 21, 22, 23, 24 surrounding cutout 64.

Coupling winding 3 has a portion 34 surrounding passing leg 45 and a portion 35 surrounding passing leg 55 and thus forms a closed loop in a sense of a short-circuit winding, i.e. forms a conductive ring. The coupling winding may be disposed in two layer planes 31, 32 and is surrounded on all sides by an insulating layer having a thickness that makes up a partial isolation separation distance of L/2. Here, "L" is the total isolation separation distance calculated from the plate thickness of the conductor substrate 6 minus the spacing of layer planes 31, 32 from each other. Layer planes 12, 13, and 22, 33 are separated from each other by an insulating layer which is referred to as a "functional isolation".

By virtue of magnetic core rings 4, 5 and coupling winding 3, the primary winding 1 and the secondary winding 2 are coupled with each, while at the same time galvanic separation is provided, with a total isolation separation distance L.

Magnetic core rings 4 and 5 with their core halves 41, 42, and 51, 52, respectively, enclose the respective ring openings 43 and 53. The core halves may be similar or different, and may be composed of different geometric shapes.

They may have rectangular, rounded, circular, or oval cross-sectional shapes. Air gaps may be provided between the core halves, but it is also possible to substantially close the air gaps if the core halves are assembled by being glued or clamped together. Specifically, the core halves may have a U-shape, I-shape, or E-shape.

As shown in FIG. 1, the layers of primary winding 1 occupy about half of the cross-sectional area of ring opening 43, while the layers 31, 32 of coupling winding 3 occupy the other half of the cross-sectional area of ring opening 43. Here, partial isolation separation distances of L/2 are maintained both to the yoke legs and to the primary winding 1.

The same situation is found on the secondary side. Here, again, the layers of the secondary winding 2 occupy about half of the cross-sectional area of the ring opening, and the coupling winding 3 maintains partial isolation separation distances of L/2 to the edge of the opening and to the layers of the secondary winding. In this manner, potential separation is provided between the primary winding 1 and the secondary winding 2, with a total isolation separation distance of 2*L/2=L, which is chosen to have a dimension such as at least required by the EN 60079-11 standard, i.e. the minimum total isolation separation distance, or more.

The coupling winding 3 is configured so as to be isolated from all other potentials. This allows the isolation separation distance L to be split into two partial isolation separation distances. The division of the total isolation separation distance L can be done in other ways, differently from a division L/2+L/2. To meet the requirements of EN 60079-11, the smaller partial isolation separation distance must be greater than L/3. As can be seen from the illustrated views, there is no need to keep large isolation distances between primary winding 1 or secondary winding 2, respectively, and the associated magnetic core rings 4 or 5. The functional isolation mentioned above will often be sufficient, so that the individual turns of the windings are not bridged by the adjacent connecting leg. Therefore, the magnetic core rings can be associated with same electrical potential as that of the windings.

The isolation separation distance between the adjacent magnetic core rings 4 and 5 is chosen sufficiently large so that the magnetic core rings keep their respective different potentials during the operation of the transformer. When the primary and secondary windings do not have large isolation distances to the associated magnetic core rings, this means that a major portion of the cross-sectional area of ring opening 43 or 53 can be used for the turns of windings 1 and 2, and this space saving translates into a greater number of turns in the same area, so that a higher inductance is achieved as compared to the case in which the windings must not come close to the edge of the ring openings. Therefore, the novel planar transformer is suitable for miniaturization.

Figure 3:
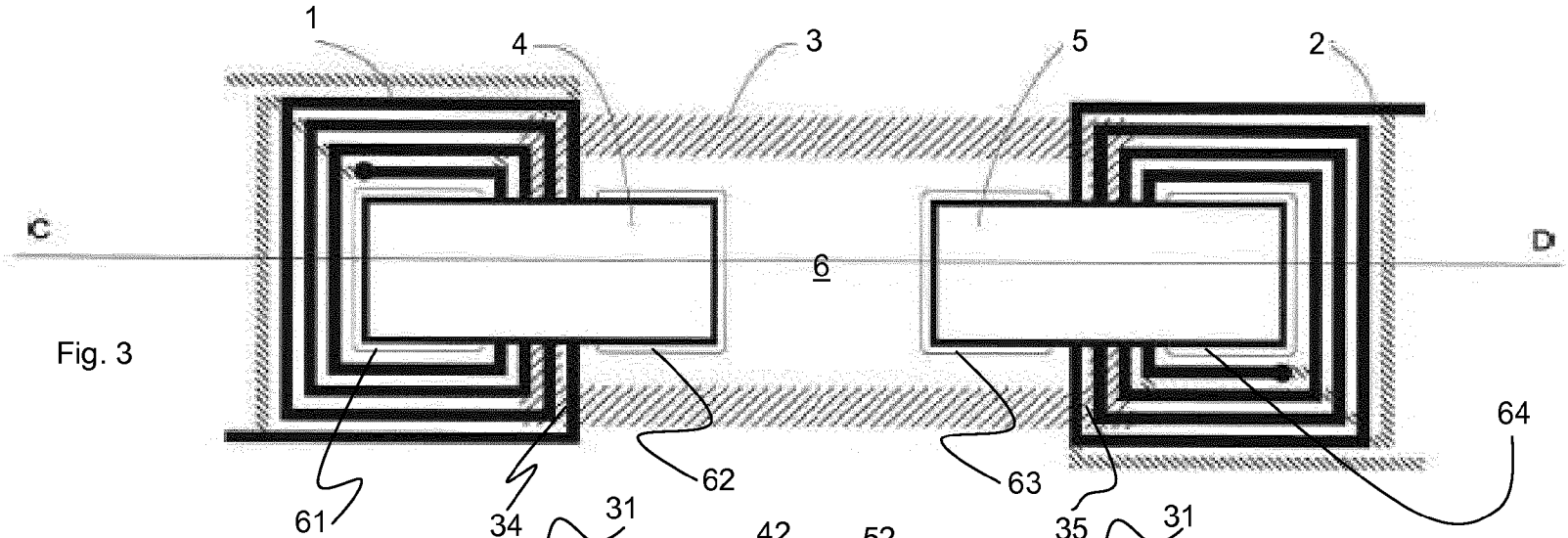
FIG. 3 is a schematic plan view of a second configuration of a transformer.
Figure 4:
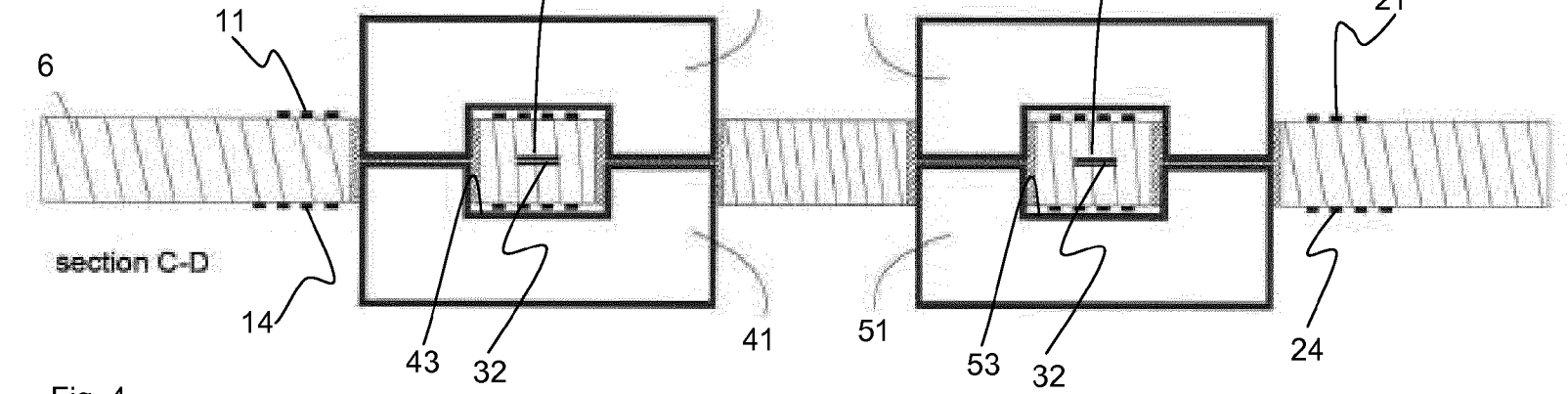
FIG. 4 is a sectional view of the transformer of FIG. 3 taken along line C-D.

FIGS. 3, 4 illustrate a variation of the transformer shown in FIGS. 1, 2, in which the inner layer of the plate-shaped conductor substrate 6 is only used for coupling winding 3 which, here again, is separated from all other potentials by half of the isolation separation distance, L/2, in each case. Primary winding 1 and secondary winding 2 are disposed on the upper and lower surfaces of conductor substrate 6 or near the surface while overlapping portions 34 and 35, respectively, of coupling winding 3. When compared to the embodiment according to FIGS. 1, 2, the ring opening 43, 53 may be smaller, but at the expense of the number of turns of the primary and secondary windings.

Figure 5:
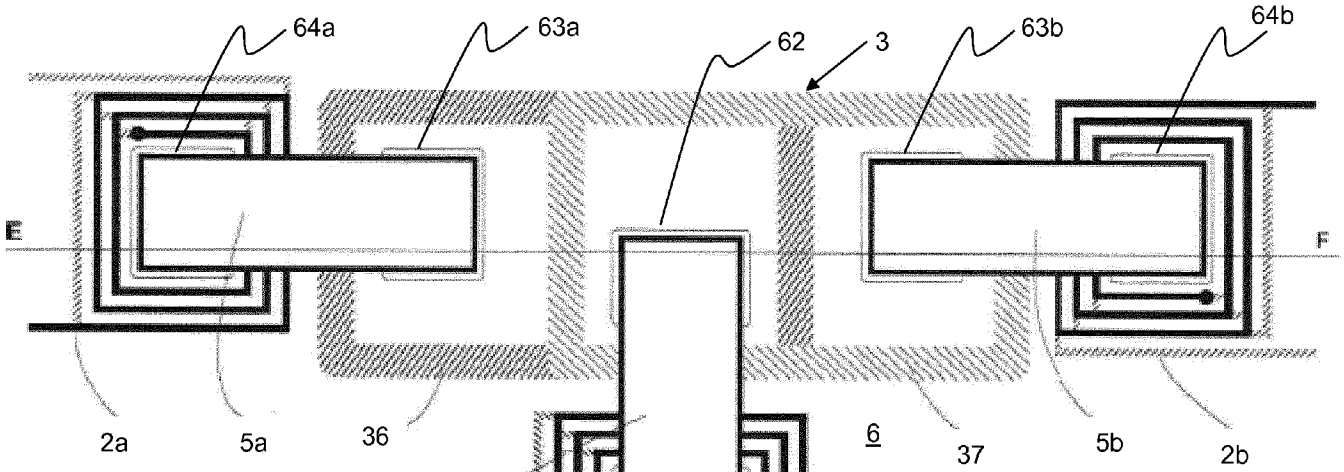
FIG. 5 is a plan view of a transformer having two secondary windings.
Figure 6:
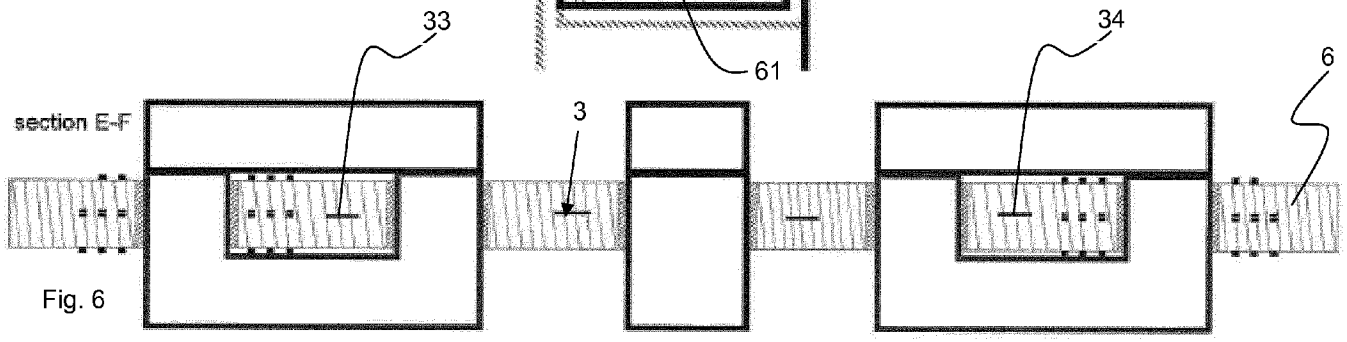
FIG. 6 is a sectional view of the transformer of FIG. 5 taken along line E-F.

FIGS. 5 and 6 show a variation of the transformer comprising two secondary windings. Accordingly, two secondary magnetic core rings 5*a*, 5*b* and two secondary windings 2*a* and 2*b* are provided, and one coupling winding 3 having two "ears" or branches 36, 37. The legs of the magnetic core rings pass through the conductor substrate 6 at openings 61, 62, 63*a*, 63*b*, 64*a*, 64*b*. The other details correspond to those of the transformer shown in FIGS. 1 and 2. However, it is likewise possible to employ the details as described with reference to FIGS. 3 and 4. In the configuration of the transformer of FIGS. 5, 6, the outputs of secondary windings 2*a*, 2*b* are independent of each other. The respective output voltage depends on the ratio of the primary winding to each respective secondary winding, i.e. the outputs are connected in parallel. If one output is not used, a current can nevertheless be tapped at the other output.

Figure 7:
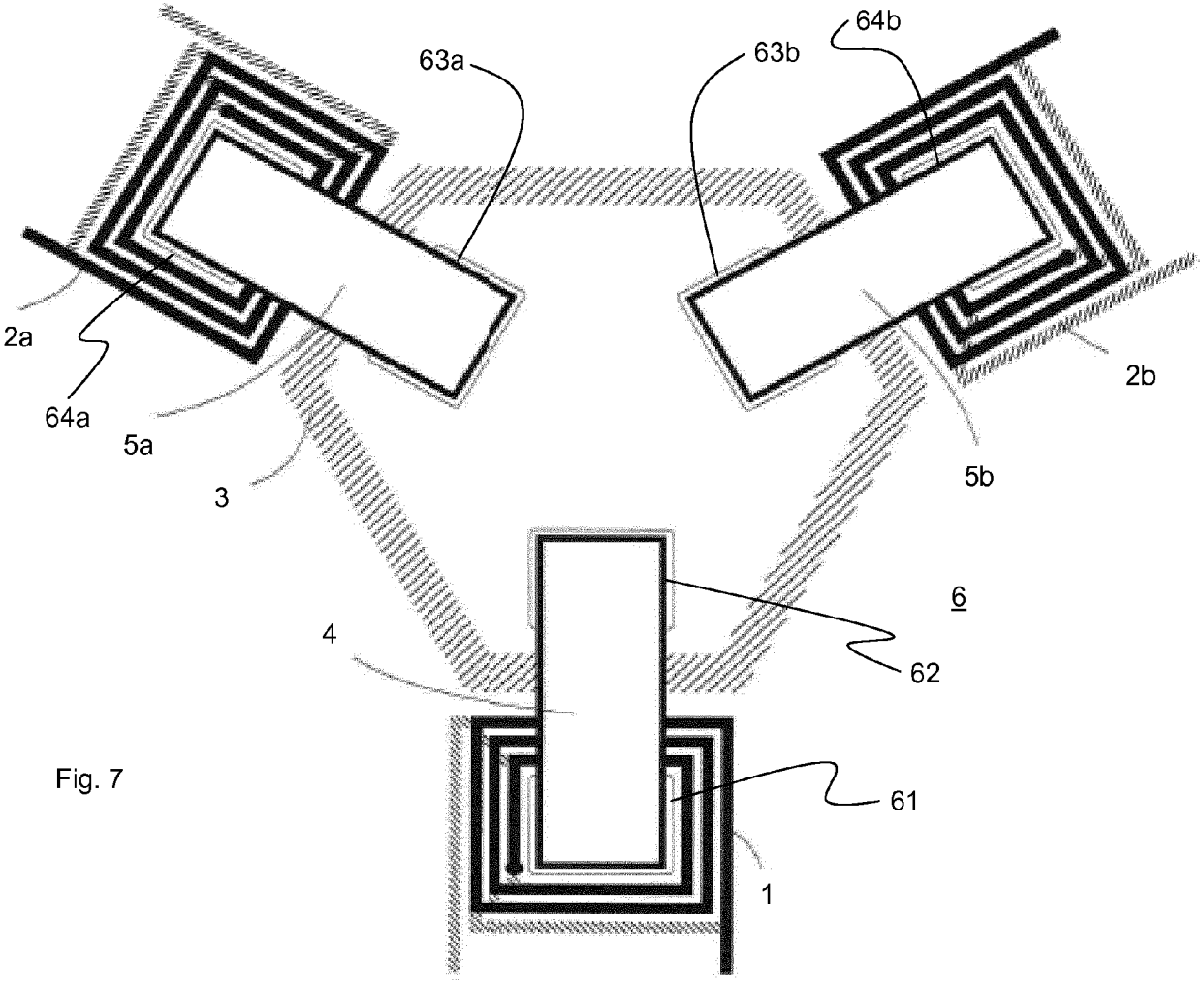
FIG. 7 is a plan view of another transformer having two secondary windings.

FIG. 7 shows a further variation of the transformer having two secondary windings 2*a*, 2*b*. For this variation, three magnetic core rings 4, 5*a*, 5*b* are used, and one coupling winding 3 that couples all three magnetic core rings 4, 5*a*, 5*b* with each other. The legs of the magnetic core rings pass through the conductor substrate 6 at openings 61, 62, 63*a*, 63*b*, 64*a*, 64*b*. The outputs of the two secondary windings are not functionally independent, since they are connected in series in the equivalent circuit diagram. This means that in the ideal case a respective current can only flow at the two outputs at the same time.

Figure 8:
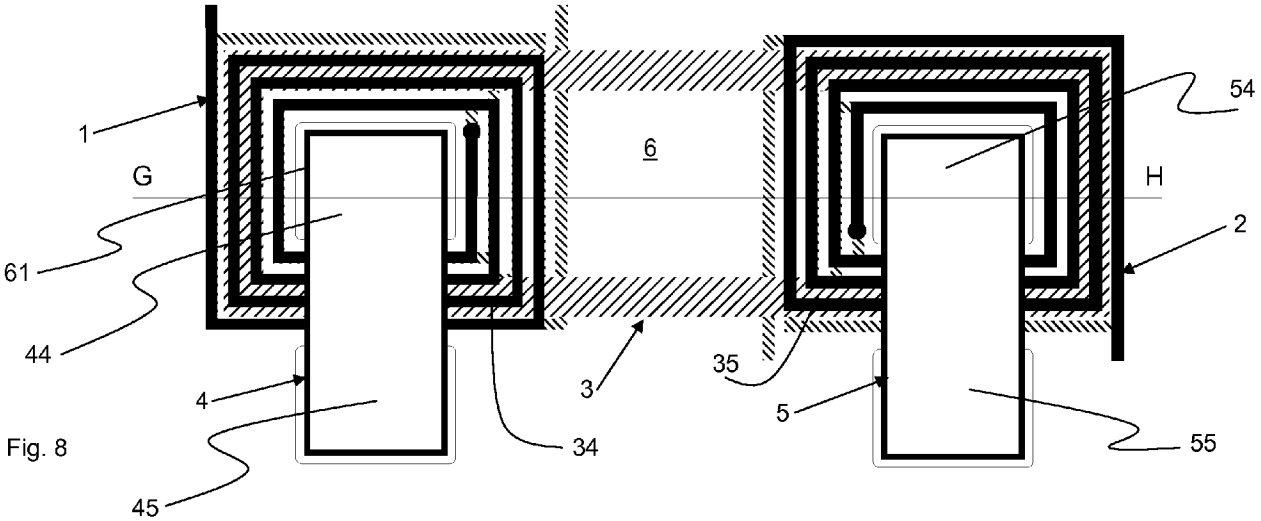
FIG. 8 is a schematic plan view of a further transformer.

FIGS. 8 and 9 illustrate a configuration of the transformer, in which each of the magnetic core rings 4, 5 has a leg, 44 and 54, respectively, that is looped by two windings. Leg 44 is looped by primary winding 1 and by a portion 34 of coupling winding 3, while leg 54 is looped by secondary winding 2 and by a portion 35 of coupling winding 3. Leg 45 which is parallel to leg 44, and leg 55 which is parallel to leg 54 are thus free and may for example be enclosed by an auxiliary winding which is usable for control purposes. As can be seen from FIG. 9, primary winding 1 and secondary winding 2 are disposed on the upper and lower surfaces of conductor substrate 6 or near the surface and are partially overlapped by portions 34, 35 of coupling winding 3 which may be disposed in two layers 31, 32.

Figure 10:
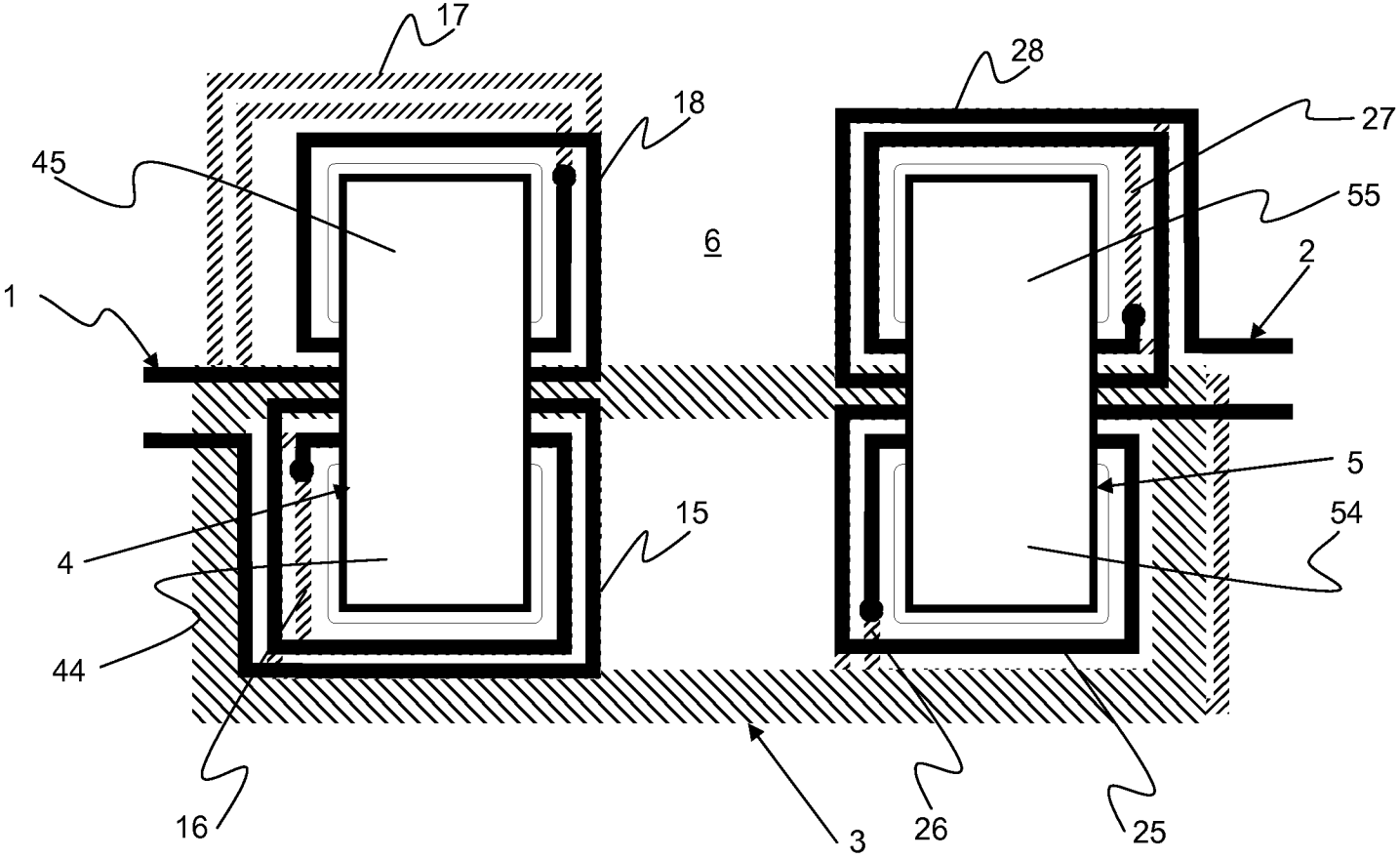
FIG. 10 is a schematic plan view of a variation of the further transformer shown in FIGS. 8, 9.

FIG. 10 shows a variation of the embodiment according to FIGS. 8, 9. Legs 44, 45 and 54, 55 of the two magnetic core rings 4 and 5, respectively, are each occupied by spiral winding portions 15, 16, 17, 18, and 25, 26, 27, 28, respectively. Winding portion 15 forms left-handed spiral turns on the upper surface of conductor substrate 6 and passes through the conductor substrate in a via to form again left-handed spiral turns at the lower surface of conductor substrate 6, which are largely obstructed by winding portion 15 in the drawing so that only traces thereof are seen in the drawing. At the lower surface, winding portion 16 is electrically connected to winding portion 17, namely to the outer turn of winding portion 17. Thence, right-handed spiral turns are formed, which again are partially obstructed by winding portion 18. Through a via, the conductor passes to the upper surface of conductor substrate 6, where the right-handed spiral turns continue until a conductor terminal at the outer edge of conductor substrate 6. The shape of secondary winding 2 is a mirror image of the shape of primary winding 1. Coupling winding 3 extends in a layer plane in the interior of conductor substrate 6 as illustrated in FIG. 9.

Figure 11:
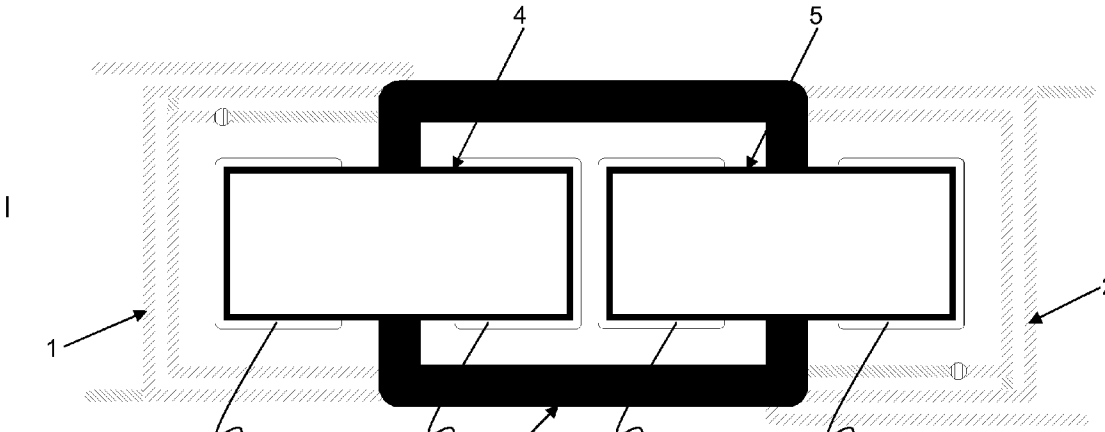
FIG. 11 is a schematic plan view of another transformer with the coupling winding arranged close to the surface.
Figure 12:
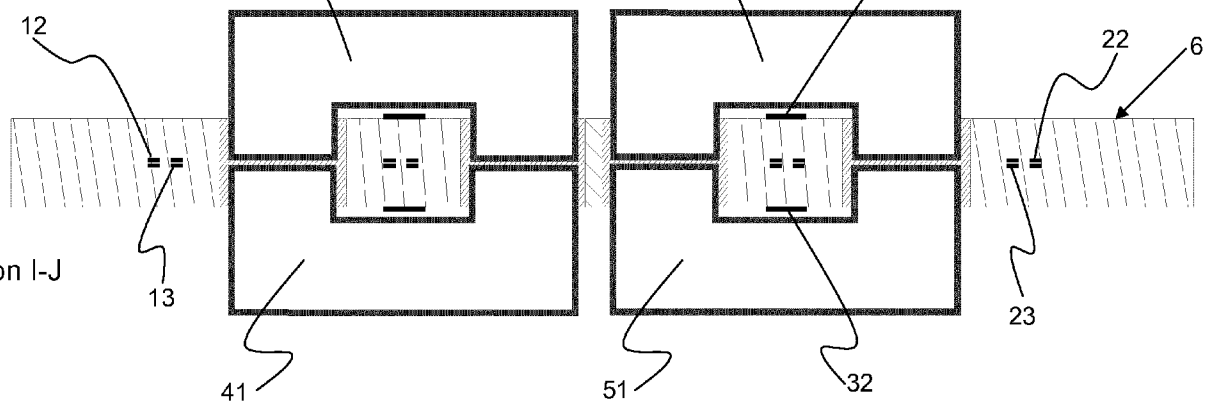
FIG. 12 is a sectional view of the transformer of FIG. 11 taken along line I-J.

FIGS. 11 and 12 show an embodiment of the transformer in which the coupling winding 3 is disposed on the upper and lower surfaces of the conductor substrate 6 and thus has the same potential as magnetic core rings 4, 5. An isolation separation distance between the magnetic core rings is not required. The primary winding 1 and the secondary winding 2 extend in inner layers of the conductor substrate with half the isolation separation distance to the magnetic core rings 4, 5 and to the coupling winding 3 in each case. Core halves 41, 42 and 51, 52 are U-shaped, for example. Here, as in the other embodiments, it is also possible for the magnetic core rings to be assembled in another way than illustrated, and each of the halves may consist of more than one part. For example, four leg bars may be assembled to form a magnetic core ring.

Figure 13:
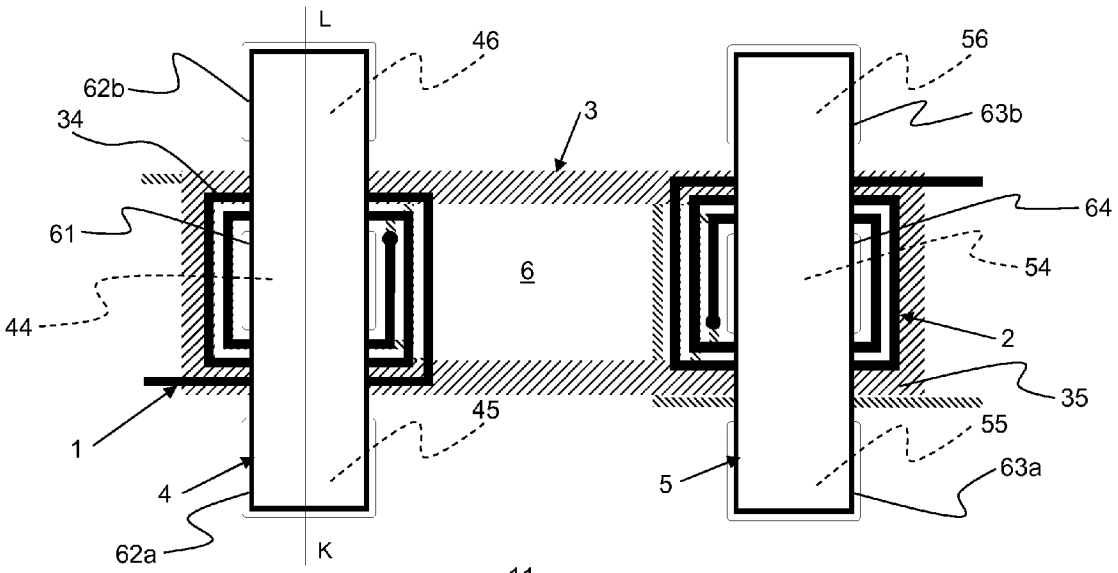
FIG. 13 is a schematic plan view of another transformer comprising E-shaped core halves.
Figure 14:
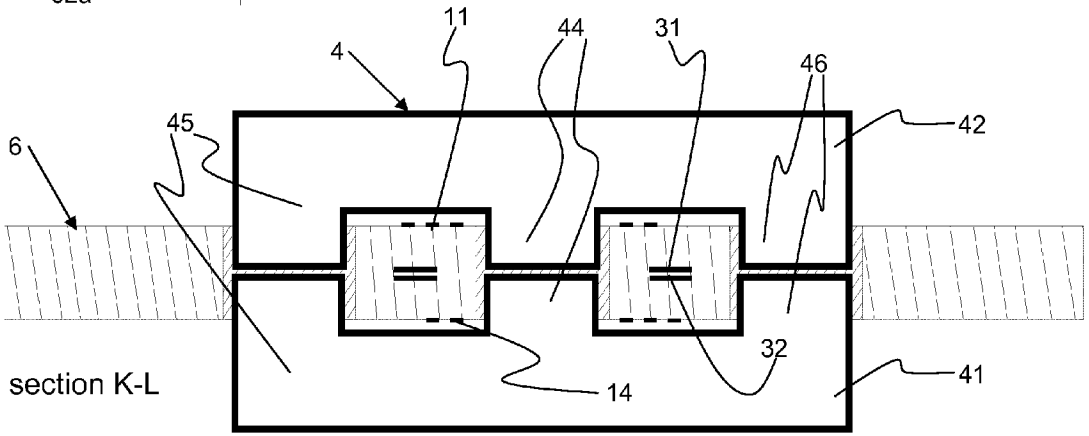
FIG. 14 is a sectional view of the transformer of FIG. 13 taken along line K-L.

FIGS. 13, 14 show an embodiment of the transformer comprising E-shaped core halves 41, 42 which when assembled form a central web corresponding to leg 44, which extends through opening 61 in conductor substrate 6. The other magnetic core ring 5 also has such a central web to form leg 54. Leg 44 is spirally surrounded by primary winding 1, and leg 54 by secondary winding 2, in two layer planes 11, 14 similarly to what is illustrated in FIG. 9. Coupling winding 3 with its portions 34, 35 forms a closed loop around the two central webs of the magnetic core rings. This may be accomplished in two layer planes 31, 32 in the interior of conductor substrate 6.

Because of the E-shape of core halves 41, 42 and 51, 52, three openings 61, 62*a*, 62*b*, and 64, 63*a*, 63*b*, respectively, are required in conductor substrate 6 in each case. Two of these openings each are considered as pairs within the meaning of the appended claims. The embodiment of FIGS.

13, 14 functionally corresponds to the embodiment of FIGS. 8, 9. However, a configuration according to FIG. 10 may also be used, in which the third leg, 46 and 56, respectively, is available for an auxiliary winding. Also, the configuration according to FIGS. 1, 2 could be applied for yoke legs 44, 45, and 54, 55, with free legs 46, 56 for replacement purposes. Finally, two or three primary windings and corresponding secondary windings might even be combined with each other, for example for replacement purposes in the event of a failure.

In all embodiments, the plate-shaped conductor substrate 6 is preferably manufactured as an electronic circuit board. However, manufacturing as an injection-molded substrate is also possible. The transformer may be produced as an individual component with a separate circuit board, though in this case this component has to be fitted on a main circuit board, or it may directly be integrated into a main circuit board.

Besides the variations described above, further variations are possible. For example it is possible to provide the primary winding and/or the secondary winding with one or more center taps.

The transformer is manufactured as follows:

Two-part ferromagnetic cores having yoke legs as described and illustrated are provided. The ferromagnetic cores comprise two halves 41, 42, and 51, 52, respectively, which can be assembled to form a closed annular structure, namely magnetic core rings 4, 4*a*, 4*b*, 5, 5*a*, 5*b*, and which do not necessarily consist of only two parts. In addition, a conductor substrate 6 is provided, which has at least two pairs of recesses 61, 62, 63, 64 defining yoke leg openings, namely an own pair of cutouts for each magnetic core ring separate from other pairs. At least one of the two recesses of the first pair, namely opening 61 has been produced so as to be surrounded by primary winding 1, similar to the second recess 64 of the second pair with respect to the secondary winding 2. The other recess 62 of the first pair is coupled with the recess 63 of the adjacent pair of cutouts through coupling winding 3.

Yoke core halves 41, 42 and 51, 52 are assembled to form magnetic core rings 4, 5 by inserting the yoke legs into the corresponding cutouts of conductor substrate 6 and closing the yoke core halves to form a respective magnetic circuit. In this way, primary winding 1 is electromagnetically coupled with coupling winding 3 and via the latter with secondary winding 2.

It can be seen from the above that the transformer according to the invention is easy to manufacture. Potential separation can be achieved between the primary side and the secondary side, such as required for example according to EN 60079-11 for hazardous areas. Only small space is required within the ring structure of the magnetic core rings, since a comparatively large packing density of the windings is possible on the primary side and on the secondary side, without need to employ the conventional winding around yoke legs. Therefore, cost-efficient manufacturing of the novel transformer is facilitated, even with a miniaturized configuration of the transformer.

What is claimed is:

1. A planar transformer, comprising:

a primary winding (1);

at least one secondary winding (2);

at least one coupling winding (3);

a first magnetic core ring (4) having a ferromagnetic core and having yoke legs (44, 45) and comprising two yoke core halves (41, 42) which surround a first ring core opening (43);

a second magnetic core ring (5) having a ferromagnetic core and having yoke legs (54, 55) and comprising two yoke core halves (51, 52) which surround a second ring core opening (53); and a single plate-shaped conductor substrate (6) having at least two pairs of recesses (61, 62; 63, 64) which define openings for accommodating the yoke legs (44, 45; 54, 55) of the ferromagnetic cores;

wherein at least one (61) of the two recesses of a first pair is surrounded by the primary winding (1) and this recess (61) or the other recess (62) of the first pair is looped by a first portion (34) of the coupling winding (3);

wherein furthermore at least one (64) of the two recesses of the second pair is surrounded by the secondary winding (2) and this recess (64) or the other recess (63) of the second pair is looped by a second portion (35) of the coupling winding (3);

wherein the primary winding (1), the secondary winding (2), and the coupling winding (3) are formed as integral portions of the single plate-shaped conductor substrate;

wherein at least a total isolation separation distance of the length L is maintained between the primary winding (1) and the secondary winding (2), for potential separation;

wherein the primary winding (1) extends along a spiral path in two or more layer planes (11, 12, 13, 14) of the single plate-shaped conductor substrate (6);

wherein the at least one secondary winding (2) extends along a spiral path in two or more layer planes (22, 23) of the single plate-shaped conductor substrate (6);

wherein the coupling winding (3) extends in layer planes (31, 32) within the plate-shaped conductor substrate (6);

wherein both the layer planes (12, 13) of the primary winding (1) and the layer planes (22, 23) of the secondary winding (2) only extend within the plate-shaped conductor substrate (6);

wherein the coupling winding (3) extends on the surface of the plate-shaped conductor substrate (6) or near the surface thereof;

wherein the layer planes (12, 13) of the primary winding maintain a first partial isolation separation distance to the coupling winding (3) and to the first magnetic core ring, each, wherein the layer planes (22, 23) of the secondary winding maintain a second partial isolation separation distance to the coupling winding (3) and to the second magnetic core ring, each, and wherein the total isolation separation distance is made up of the sum of the first partial isolation separation distance and the second partial isolation separation distance.

2. The planar transformer as claimed in claim 1, wherein the first partial isolation separation distance is in the range of L/3 to L/2, while the second partial isolation separation distance is in the range of 2L/3 to L/2 or vice versa.

* * * * *